US005560510A

United States Patent [19]

Grebenyuk et al.

[11] Patent Number: 5,560,510

[45] Date of Patent: Oct. 1, 1996

[54] SALVAGE DRUM WITH IMPROVED LID TIGHTENING MEANS

[75] Inventors: Alexander Grebenyuk, Williamsfield; James P. Onders, Independence; Darel R. Taylor, Chardon, all of Ohio

[73] Assignee: ENPAC Corporation, Chardon, Ohio

[21] Appl. No.: 186,305

[22] Filed: Jan. 25, 1994

[51] Int. Cl.[6] ..... B65D 41/04

[52] U.S. Cl. ..... 220/284; 220/288

[58] Field of Search ..... 220/288, 244, 220/274, 284

[56] References Cited

U.S. PATENT DOCUMENTS

| | | | |
|---|---|---|---|
| 3,939,967 | 2/1976 | Tenney et al. . | |
| 4,055,275 | 10/1977 | Gontar | 220/244 |
| 4,390,112 | 6/1983 | Tysver | 220/274 |
| 4,708,258 | 11/1987 | Shaw et al. . | |
| 4,730,747 | 3/1988 | Schiemann | 220/288 |
| 4,784,263 | 11/1988 | Stanley | 220/288 |
| 4,978,004 | 12/1990 | Silverstein et al. | 220/288 |
| 5,111,955 | 5/1992 | Baker et al. | 220/288 |

*Primary Examiner*—Joseph M. Moy

*Attorney, Agent, or Firm*—Pearne, Gordon, McCoy & Granger

[57] ABSTRACT

A salvage drum for hazardous materials includes a container and a lid threaded thereon. Projections on the container and lid are engaged by a lever, such as a two-by-four beam. The lever is wrenched to tighten the lid on the container. The projections are symmetrically spaced around the container and lid. The lever can be a bar having a crank with teeth.

20 Claims, 4 Drawing Sheets

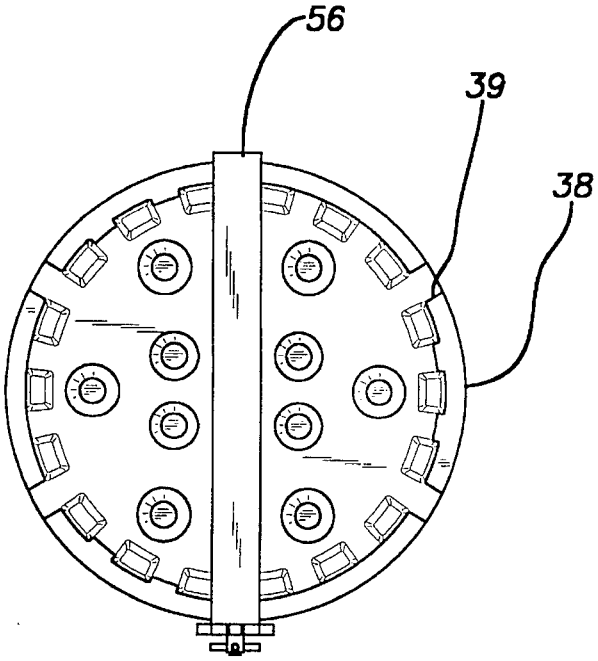
Fig.9
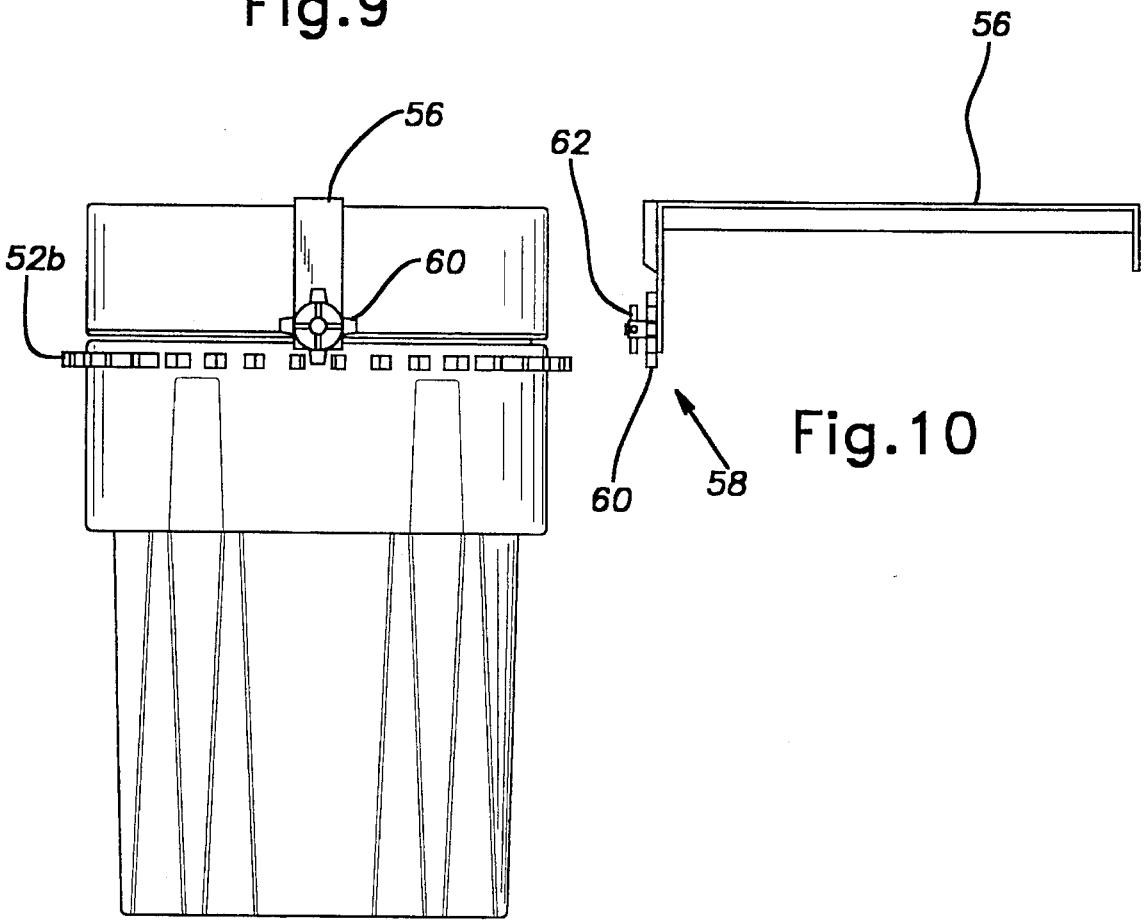
Fig.10
Fig.8

SALVAGE DRUM WITH IMPROVED LID TIGHTENING MEANS

BACKGROUND OF THE INVENTION

The present invention relates to a salvage drum and more particularly to a polyethylene salvage drum for use in containing hazardous materials.

Polyethylene salvage drums for use in containing hazardous materials and in overpacking other drums containing hazardous materials are known in the art. Such drum-type containers must be corrosion resistant, should combine mechanical strength with light weight, and must be sufficiently strong at all points of construction so as to provide a safe container for the hazardous materials without leaking, despite the rough handling such containers undergo during transportation and handling. For use in the United States, such containers must be approved by the U.S. Department of Transportation (DOT) which requires that the containers undergo rigorous testing. In particular, DOT testing requires dropping of a container, generally filled with water, from a specified height onto a concrete slab. The angle at which the container is dropped onto the concrete slab is varied. Accordingly, hazardous material salvage drums must be extremely strong and well constructed. In addition, the drum containers should be stackable, both when loaded and when unloaded. Furthermore, simple and convenient means for threading on and off the lid of a threaded container for nuclear or hazardous materials should be provided.

One such drum is shown in U.S. Pat. No. 4,708,258 to Shaw, et al., which is incorporated herein by reference. A screw on lid is provided with channels defined by castellations for receiving a two-by-four or the like for tightening the lid. Such a container requires one person to hold the container and another to screw on the lid.

SUMMARY OF THE INVENTION

There still exists a need in the art for an improved means for securely closing a polyethylene salvage drum which is mechanically strong, affordable, and suitable for containing hazardous materials in a leak-tight manner. Specifically, there is a need in the art of hazardous waste disposal for a polyethylene salvage drum with a threaded lid which is easier to tighten or loosen than prior art drums. Preferably, the drum is nestable and light in weight, has an internal volume large enough to receive all DOT and a non-DOT specification drums of 55 gallons or smaller, and which has no metal parts, so that it is capable of being completely incinerated. It is, therefore a primary objective of this invention to fulfil this need by providing a polyethylene hazardous material salvage drum which exhibits great mechanical strength and resistance to leakage and satisfies all the foregoing requirements for containing hazardous materials.

More particularly, it is an object of this invention to provide a hazardous material salvage drum which is made by rotationally molding the container and lid from a linear low or medium density polyethylene.

It is another object of this invention to provide a hazardous material salvage drum which is nestable and stackable in both the filled and unfilled conditions.

Another object of this invention to provide a hazardous material salvage drum which has means for containment of gasses which may build up within the drum.

Yet another object of this invention is to provide a polyethylene salvage drum with a male thread and a lid with a female thread for threadably securing the lid to the drum in a leak-tight manner such that a build-up of internal gas pressure will cause enhancement of the leak-tight seal between the drum and lid.

Another object of the invention is to provide a double wall, rotationally molded polyethylene drum lid which has sufficient mechanical strength to meet handling requirements in a leak-free manner.

Still another object of this invention is to provide a hazardous material salvage drum which is provided with means to permit handling by a fork-lift or the like, yet is designed so as to make it impossible for a handler of the drum to insert the fork of the fork-lift or other lifting device between the lid and the drum container.

The present invention provides a container having a generally cylindrical upper portion, said upper portion having threads disposed thereon; a generally horizontal container projection on said container; a lid having threads disposed thereon adapted to mate with the threads of the container; a lid projection extending from said lid; and a lever engageable with the container projection and the lid projection so as to permit the lid to be rotated relative to the container by wrenching the lever.

The lever may be a bar having a crank journalled on the bar and having teeth. A vertically projecting castellation extends from the lid, and the bar engages the castellation. The container has a plurality of equi-angularly spaced container projections so that successive teeth engage successive container projections as the crank is rotated.

According to one embodiment of the invention, a drum has a container having a generally cylindrical upper portion, said upper portion having threads disposed thereon. A plurality of symmetrically spaced generally horizontal container projections extend from said container. A lid has threads disposed thereon adapted to mate with the threads of the container. A plurality of symmetrically spaced lid projections extend from said lid. A lever is engageable with any of the container projections and any of the lid projection so as to permit the lid to be rotated relative to the container by wrenching the lever.

The invention is an improvement of a drum comprising a container having a side wall and a circular bottom wall. The side wall has an exterior surface, an interior surface, an upper side wall portion, a lower side wall portion, and an enlarged diameter side wall portion intermediate the upper and lower side wall portions. The exterior surface of the upper side wall portion is provided with male threads. An annular shoulder is formed between the lower side wall portion and the enlarged diameter side wall portion. A lid is provided which has a double walled body and a double walled annular skirt depending from the double walled body. The skirt has an interior circumferential surface and an exterior circumferential surface. The interior circumferential surface of the skirt is provided with female threads for mating with the male threads of said container. The improvement according to this invention comprises a container projection extending from the exterior surface of the side wall of the container and a lid projection extending outwardly from the lid. A lever is engageable with the container projection and the lid projection so as to permit the lid to be rotated relative to the container by wrenching the lever.

A method of tightening a threaded lid on a container having a correspondingly threaded opening is also disclosed. The steps include placing the lid on the container; rotating the lid so as to engage the respective threads; engaging a lever with a projection on the lid and a projection on the container; and wrenching the lever so as to rotate the lid firmly onto the container. Additional steps include engaging the lever with a second projection on the lid and rotating the lid prior to engaging the lever with the first projection on the lid.

With the foregoing and other objects, advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 8 is a side elevational view of the drum according to a third embodiment;

FIG. 9 is a top view of the lid according to the third embodiment; and

FIG. 10 shows a bar and crank according to the third embodiment.

DETAILED DESCRIPTION OF THE PREFERRED EMBODIMENT

Figure 1:
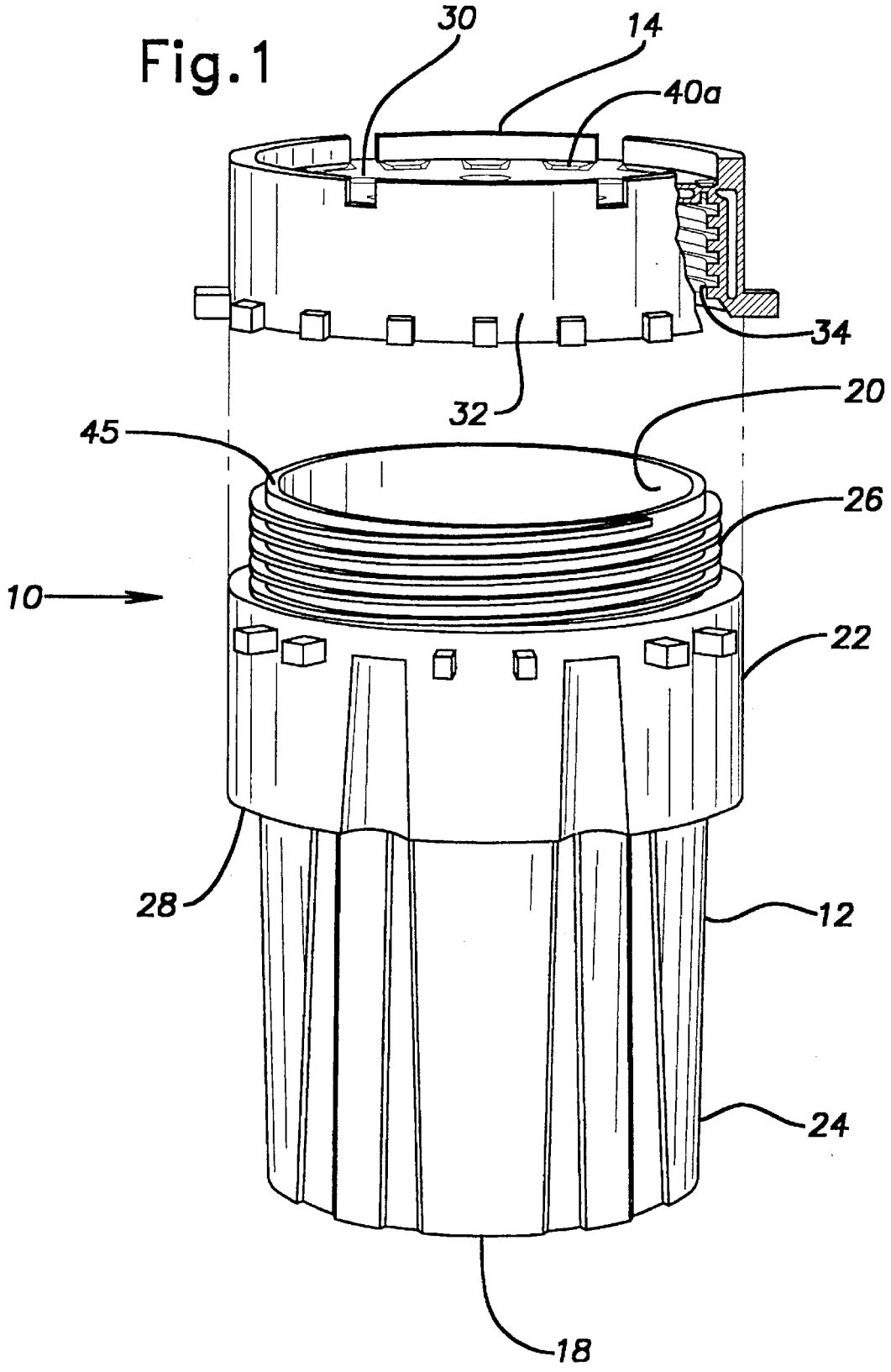
FIG. 1 is a perspective view of the hazardous material salvage drum in accordance with a first embodiment of the invention, showing both the container and the lid of the drum.

Referring to FIG. 1, a molded polyethylene salvage drum 10 for containing hazardous material has two parts, a container 12 and a lid 14.

The container 12 is rotationally molded, preferably of a linear, low-density polyethylene, with a solid, slightly outwardly tapered sidewall 16 and a circular bottom wall 18. The side wall 16 is divided into three portions, an upper or top side wall portion 20, an enlarged side wall portion 22 adjacent the upper portion 20, and a lower side wall portion 24 adjacent enlarged portion 22 and having a diameter smaller than those of the enlarged portion 22 and the upper portion 20. The upper portion 20 is provided on its exterior circumferential surface with a plurality of male threads 26. An annular shoulder 28 is formed on container 12, between enlarged portion 22 and the lower portion 24.

The lid 14 is rotationally molded with a double-walled body 30, which provides structural rigidity and strength to lid 14. Depending from the double-walled body 30 is a double-walled annular skirt 32. On the inside circumferential surface of skirt 32 there are formed a plurality of female threads 34. The female threads of the lid 14 mate with and threadably engage the male threads 26 formed on the outer surface of the upper portion 20 of container 12. By using male threads on the drum and female threads on the drum lid, pressure which builds up inside container 10 will tend to tighten the threaded connection in a leak-proof manner.

Figure 2:
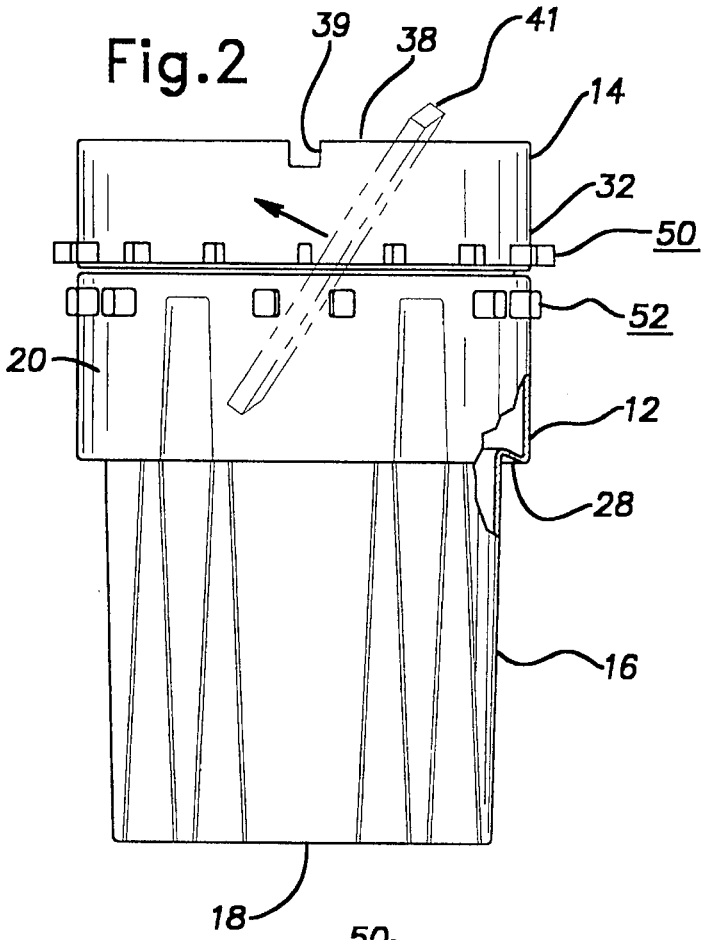
FIG. 2 is an elevational view of the hazardous material salvage drum in accordance with the invention, with the lid threaded onto the container.
Figure 4:
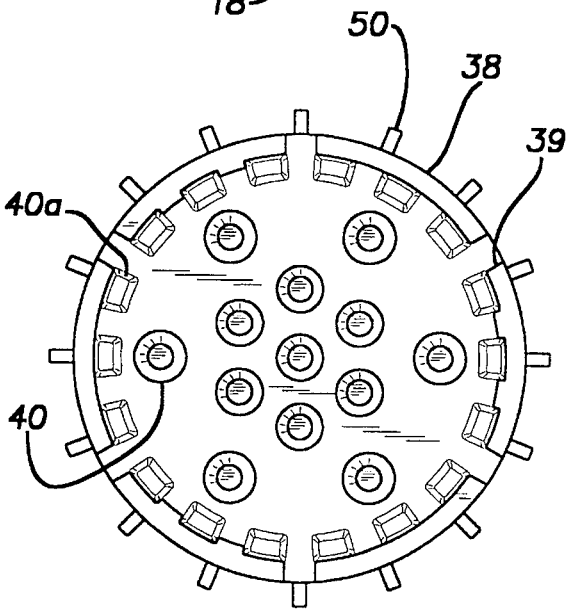
FIG. 4 is a top view of the lid of the hazardous material salvage drum according to the first embodiment of the invention.
Figure 5:
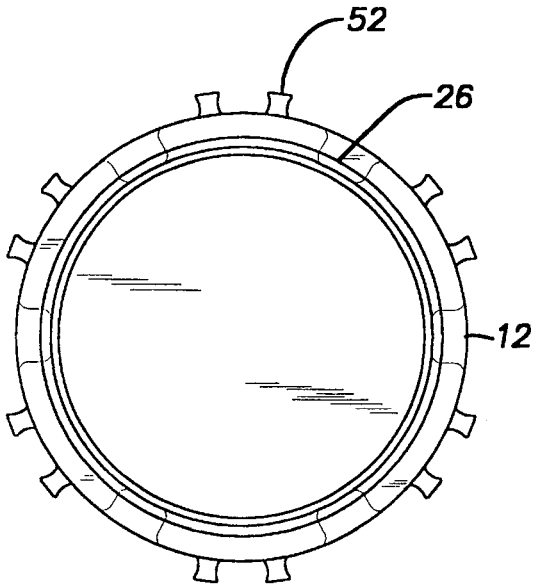
FIG. 5 is a top view of the container according to the first embodiment.

Referring now to FIG. 4 with further reference to FIG. 2, the double-walled body 30 of lid 14 is rotationally molded with a plurality of "kiss-off" portions 40. The "kiss-off" portions 40 are formed as frusto-conical recesses or cavities when the two walls of double-walled body 30 are brought together to form a single wall at discrete locations on the lid during the process of rotationally molding lid 14. Other "kiss-off" portions **40*a*, disposed around the perimeter of the lid, are formed in a trapezoidal shape. The "kiss-off" portions 40 and 40*a* provide additional rigidity for the double-walled body 30 of lid 14**.

As shown in FIGS. 1–3 and FIG. 6, the lid 14 is provided with a plurality of vertical castellations 38 which project upwardly from the upper surface of body 30 and which are arranged in equi-angularly spaced relation around the periphery of body 30. Gaps 39 between castellations 38 are made sufficiently large to accommodate a beam 41, such as a 2"×4" wooden beam, to provide a means for tightening and loosening of lid 14 on container 12. The castellations 38 of a first container are arranged on the periphery of the lid 14 and are formed with an inner diameter large enough to accommodate the bottom wall 18 of a second container when the lid 14 is threaded into place on the first container. By reason of the double wall structure of the body 30 and the "kiss-off" portions, the lid 14 is sufficiently strong to accommodate a plurality of filled or unfilled drums stacked one on top of the other.

A plurality of horizontal castellations or lid projections 50 extend outwardly from the skirt 32. The lid projections 50 are generally equi-angularly spaced around the lid 14 and spaced so as to receive the beam 41 therebetween. Container projections 52 extend outwardly from the enlarged portion 22 of the container 12. The container projections 52 are also spaced around the container so as to admit the beam 41. The desired location and spacing of the lid and container projections, will become apparent from the discussion below.

Figure 3:
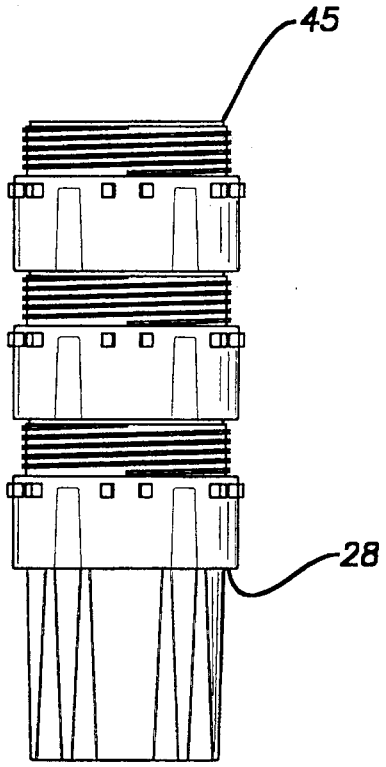
FIG. 3 is a side elevation view showing three containers stacked one inside the other, in accordance with the invention.

Referring now to FIG. 3, the nesting of unfilled containers 12 is illustrated. As shown in FIG. 3, the inside diameter of upper side wall portion 20 of container 14 is greater than the outer diameter of lower side wall portion 24 of the container to allow nesting. An annular tapered shoulder 28 formed between enlarged portion 22 and lower portion 24 defines a conical surface which provides a self-centering annular groove for the upper edge 45 of another container which nests in the groove.

In use, the container 10 of the invention is first filled by placing a drum containing hazardous material in the container 12 (overpacking). The lid 14 is then placed into position on container 12 so that the female threads 34 of lid 14 engage the male threads 26 on container 12. The lid is then rotated, thereby threading the lid 14 onto container 12. A 2"×4" beam may be placed in oppositely disposed gaps 39 formed between castellations 38 to aid in rotation of lid 14. The lid 14 is threaded on the container 12 to the position shown in FIG. 2 in which an upper edge 45 of upper portion 20 of the container compresses a gasket (not shown) disposed in a recess in the lid. Tightening of the lid 14 is accomplished by placing the beam 41 between two of the lid projections 50 and two of the container projections 52. The beam engages one of the lid projections and one of the container projections. The beam 41 is wrenched, that is rotated or twisted, as shown by the arrow in FIG. 2, to act as a lever so as to create sufficient torque on the lid 14 to tighten the lid. In this way, the lid is rotated relative to the container without need for a separate means of holding the container in place. If pressure builds up in the container, the internal pressure tightens the threaded connection of the male threads on container 12 and the female threads on lid 14.

Several filled containers can be stacked on top of the other with the bottom wall 18 of one container nesting within the castellations 38 provided on the lid of another drum. When it is desired to remove the hazardous material from the drum 10, the beam 41 is inserted between lid and container projections and wrenched so as to loosen the lid. Then the beam may be inserted in a pair of oppositely disposed gaps between castellations 38 to aid in unthreading and removing lid 14 from container 12. The hazardous materials may then be removed from the drum 10. When containers 12 are not in use they may be nested together, as illustrated in FIG. 3.

Figure 7:
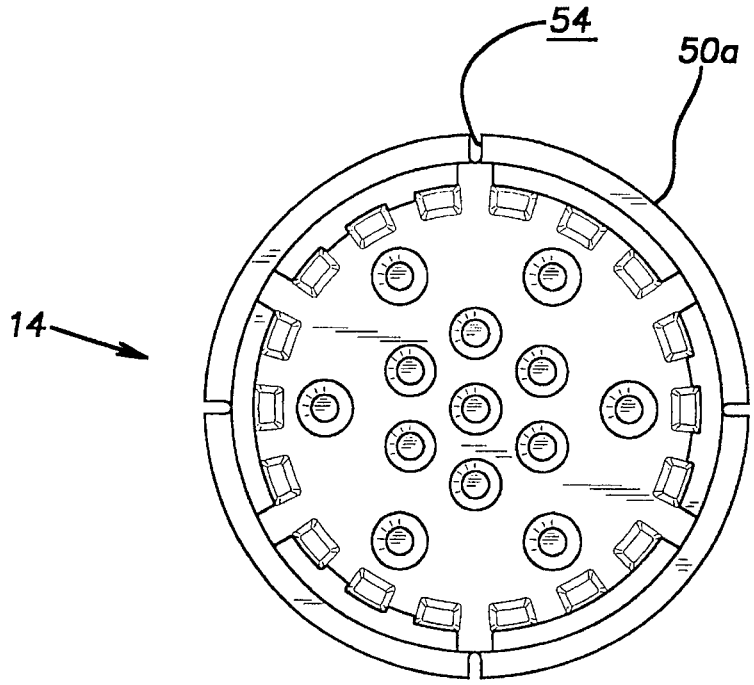
FIG. 7 is a top view of the lid according to the second embodiment.
Figure 6:
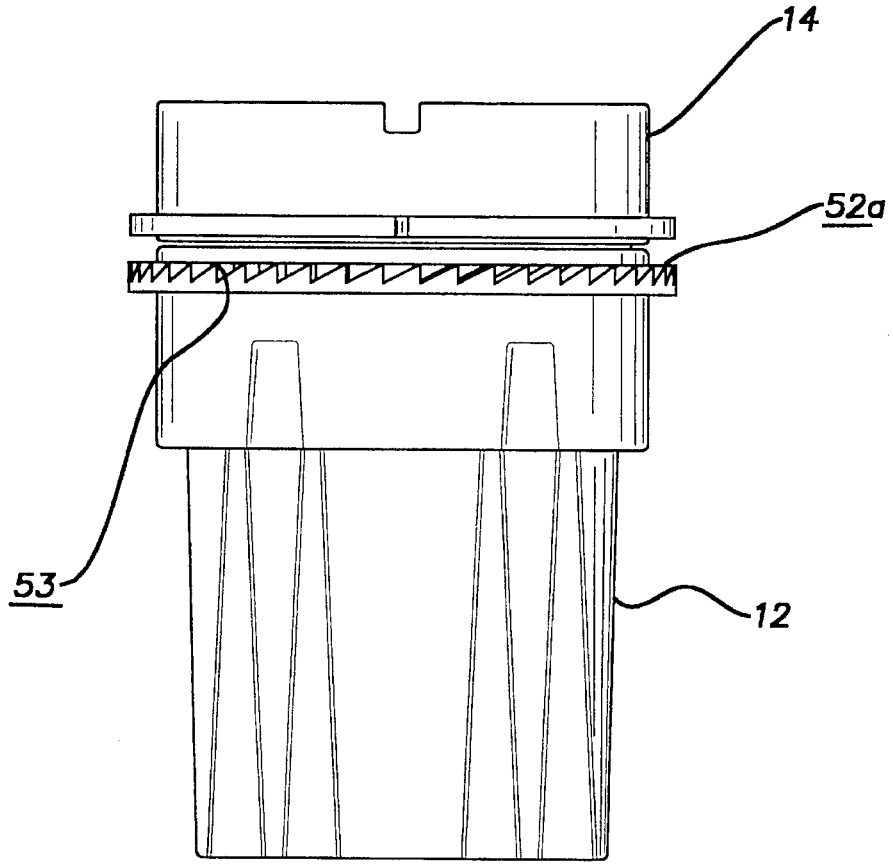
FIG. 6 is a side elevational view of the drum according to a second embodiment.

Referring to FIGS. 6 and 7, an alternative configuration of the lid and container projections is shown. The lid projections comprise horizontal castellations 50*a* defining a plurality of gaps 54 for receiving an end of the beam 41. The container projections comprise a plurality of saw-tooth projections 52*a* which have faces 53 disposed around the container 12 for engaging the end of the beam 41 . The beam 41 is used as a lever engaging one of the castellations and one of the saw-tooth projections to tighten or loosen the lid. To provide uniform leverage for loosening and tightening, alternating saw-tooth projections may be sloped in opposite directions.

Referring to FIGS. 8, 9, and 10, another embodiment is shown. As shown in FIGS. 8 and 9, the horizontal lid projections are not used. A plurality of container projections 52*b* are provided similar to those in FIG. 1, but closely and regularly spaced. A lid projection comprising a bar 56 having a crank 58 journalled thereon is inserted in two of the channels 39 defined by the vertical castellations 38. The crank has teeth 60 and a handle 62 for rotation. The teeth engage the container projections 52*b*. To tighten the lid, the handle is rotated so that the teeth 60 engage successive projections 52*b* and act as a lever between the lid and the container. To loosen the lid, the handle is rotated in the opposite direction. The bar is removable for use on other drums and to permit stacking of the drums. The container 12 and lid 14 are preferably rotationally molded of a linear low or medium density polyethylene, such as, for example, Union Carbide's GPEP 805 linear low density polyethylene, UV inhibited. A nominal wall thickness of about 0.20 inches is preferred for both the lid and container. A typical "kiss-off" portion 40 has a diameter at the bottom of the recess of about 1.5 inches and at the top of the recess about 2.5 inches.

The present disclosure describes several embodiments of the invention, however, the invention is not limited to these embodiments. Other variations are contemplated to be within the spirit and scope of the invention and appended claims.

What is claimed is:

1. A drum, comprising:

a container having a generally cylindrical upper portion, said upper portion having threads disposed thereon;

a generally horizontal container projection on said container;

a lid having threads disposed thereon adapted to mate with the threads of the container;

a lid projection extending from said lid; and a lever engageable with the container projection and the lid projection so as to permit the lid to be rotated relative to the container by wrenching the lever.

2. A drum according to claim 1, wherein the lid projection extends generally horizontally.

3. A drum according to claim 2, further comprising a vertically projecting castellation on the lid.

4. A drum according to claim 1, further comprising a plurality of like lid projections.

5. A drum according to claim 4, wherein the lid projections are symmetrically spaced around the lid.

6. A drum according to claim 1, further comprising a plurality of like container projections.

7. A drum according to claim 6, wherein the container projections are symmetrically spaced around the container.

8. A drum according to claim 7, wherein the container projections define a saw-tooth configuration, the container projections being engageable with an end of the lever.

9. A drum according to claim 1, wherein the lid projection comprises a bar.

10. A drum according to claim 9, further comprising a vertically projecting castellation on the lid and a crank disposed on the bar, the bar engaging the castellation and the crank engaging the container projection.

11. A drum according to claim 10, wherein the crank comprises a handle and teeth journalled on the bar and the container further comprises a plurality of equi-angularly spaced container projections so that successive teeth engage successive container projections as the crank is rotated.

12. A drum according to claim 1, wherein the container is stackable within a like container when empty.

13. A drum according to claim 1, wherein the drum is stackable on the lid of a like drum.

14. A drum according to claim 1, wherein the threads on the container comprise male threads received within the threads of the lid.

15. A drum according to claim 1, wherein the lid each comprises a double walled construction.

16. A drum, comprising:

a container having a generally cylindrical upper portion, said upper portion having threads disposed thereon;

a plurality of symmetrically spaced generally horizontal container projections on said container;

a lid having threads disposed thereon adapted to mate with the threads of the container;

a plurality of symmetrically spaced lid projections on said lid; and a lever engageable with any of the container projections and any of the lid projection so as to permit the lid to be rotated relative to the container by wrenching the lever.

17. An improved drum comprising:

a container having a side wall and a circular bottom wall, said side wall having an exterior surface, an interior surface, an upper side wall portion, a lower side wall portion, and an enlarged diameter side wall portion intermediate the upper and lower side wall portions, the exterior surface of the upper side wall portion being provided with male threads, said container having an annular shoulder formed between the lower side wall portion and the enlarged diameter side wall portion; and a lid having a double walled body and a double walled annular skirt depending from the double walled body, said skirt having an interior circumferential surface and an exterior circumferential surface, the interior circumferential surface of said skirt being provided with female threads for mating with the male threads of said container, wherein the improvement comprises:

a container projection extending from the exterior surface of the side wall of the container;

a lid projection extending outwardly from the lid; and a lever engageable with the container projection and the lid projection so as to permit the lid to be rotated relative to the container by wrenching the lever.

18. A drum according to claim 17, further comprising a plurality of symmetrically spaced container projections; and a plurality of symmetrically spaced lid projections, said lid projections extending generally horizontally.

19. A method of tightening a threaded lid on a container having a correspondingly threaded opening, comprising the steps of:

placing the lid on the container;

rotating the lid so as to engage the respective threads;

engaging a lever with a projection on the lid and a projection on the container; and wrenching the lever so as to rotate the lid firmly onto the container.

20. A method according to claim 18, further comprising the step of engaging the lever with a second projection on the lid and rotating the lid prior to engaging the lever with the first projection on the lid.

* * * * *